United States Patent [19]

Hiraishi et al.

[11] Patent Number: 4,570,170

[45] Date of Patent: Feb. 11, 1986

[54] THERMOSENSITIVE RECORDING MATERIAL

[75] Inventors: Shigetoshi Hiraishi; Kazuyoshi Kondo, both of Tokyo, Japan

[73] Assignee: Mitsubishi Paper Mills, Ltd., Tokyo, Japan

[21] Appl. No.: 655,632

[22] Filed: Sep. 28, 1984

[30] Foreign Application Priority Data

Oct. 6, 1983 [JP] Japan ..... 58-188008

[51] Int. Cl.[4] ..... B41M 5/18

[52] U.S. Cl. ..... 346/209; 346/208; 427/150; 427/151

[58] Field of Search ..... 346/208, 209, 225; 427/150, 151, 152

[56] References Cited

U.S. PATENT DOCUMENTS 4,442,176 4/1984 Nagaoka et al. ..... 346/209

FOREIGN PATENT DOCUMENTS 0116690 7/1982 Japan ..... 346/209
0182483 11/1982 Japan ..... 346/209
0203589 12/1982 Japan ..... 346/209

*Primary Examiner*—Bruce H. Hess
*Attorney, Agent, or Firm*—Cushman, Darby & Cushman

[57] ABSTRACT

In a thermosensitive recording material comprising a thermosensitive recording layer provided on a support and containing a usually colorless or light-color dye precursor and a color developer which reacts with the dye precursor when heated to effect color development of the dye precursor, the image keeping quality of the recording material can be improved by further containing in the thermosensitive recording layer a compound represented by the general formula:

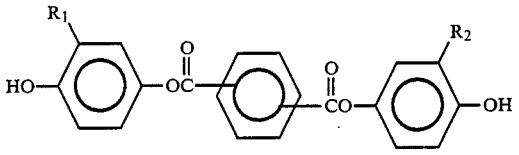

(wherein $R_1$ and $R_2$ represent an alkyl group or a halogen).

8 Claims, No Drawings

THERMOSENSITIVE RECORDING MATERIAL

BACKGROUND OF THE INVENTION

1. Field of the Invention

This invention relates to a thermosensitive recording material having excellent keeping quality of developed color images.

2. Description of the Prior Art

Generally, thermosensitive recording material is made by forming on a support a thermosensitive recording layer composed principally of a usually colorless or light-color electron donative dye precursor and an electron receptive color developer. When the recording material is heated by a heating means such as thermal head, thermal pen, laser light, etc., the dye precursor and color developer are reacted instantaneously and a color image is recorded. The relating art is disclosed in Japanese Patent Publication Nos. 4160/68 and 14039/70 and other literatures. Such thermosensitive recording material has the specific advantages such that recording can be made with a relatively simple apparatus, maintenance of the material is easy, no noise is generated in the recording operation, etc., and thanks to these features, it is now utilized in a wide range of recording systems and devices such as, for instance, measurement recorders, facsimiles, printers, computer terminals, labelers, and ticket vending machines.

It is the basic requirements for a thermosensitive recording material that it has a sufficient color image density and sensitivity and that it causes no quality deterioration of the developed color image with time. Also, with expansion of the scope of use of thermosensitive recording material in recent years, it has become the vital requirements that the obtained image suffers no deleterious change by the adhesion of oily matter such as hair cream, hand cream, oils and fats contained in skin perspiration, etc. (oil resistance of the image), or by the adhesion of water (water resistance of the image).

SUMMARY OF THE INVENTION

The present invention have made extensive researches on the additive substances, or image stabilizers, for obtaining a thermosensitive recording material having excellent image keeping quality and, as a result, found that a thermosensitive recording material with excellent keeping properties can be obtained when a compound represented by the general formula:

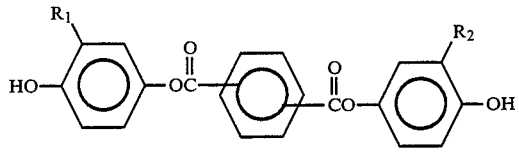

(wherein $R_1$ and $R_2$ represent an alkyl group of a halogen) is contained in a recording material produced by providing on a support a thermosensitive recording layer containing a usually colorless or light-color dye precursor and a color developer which reacts with the dye precursor when heated to effect color development of said dye precursor.

PREFERRED EMBODIMENTS OF THE INVENTION

In the general formula representing the compound used as image stabilizer in this invention, when $R_1$ and $R_2$ are each an alkyl group, such alkyl group is preferably one having 1 to 4 carbon atoms, and when $R_1$ and $R_2$ are each a halogen, such halogen is preferably chlorine.

As the image stabilizer represented by the above-shown general formula according to this invention, the following compounds can be mentioned: bis(4-hydroxy-3-methylphenyl)phthalate, bis(3-t-butyl-4-hydroxyphenyl)phthalate, bis(4-hydroxy-3-methylphenyl)isophthalate, bis(3-t-butyl-4-hydroxyphenyl)isophthalate, bis(3-chloro-4-hydroxyphenyl)-phthalate, bis(3-t-butyl-4-hydroxyphenyl)terephthalate, bis(3-chloro-4-hydroxyphenyl)terephthalate, bis(4-hydroxy-3-methylphenyl)-terephthalate, and bis(3-chloro-4-hydroxyphenyl)isophthalate.

Such image stabilizer is used in this invention in an amount preferably within the range of 10 to 250% by weight, most preferably within the range of 25 to 200% by weight, based on the dye precursor. Use of the image stabilizer in an amount less than 10% by weight can not produce the desired effect of the stabilizer, while if it is used in excess of 250% by weight, the diluting effect becomes predominant to give an adverse effect to the image density. Use of stabilizer in such great amount is also poor economy.

The main components of the thermosensitive recording material according to this invention will be described concretely below, but other materials than those mentioned below may be used within the scope of the invention.

As the dye precursor, there can be used, for example, triphenylmethane compounds, fluoran compounds, diphenylmethane compounds, thiazine compounds and spiropyran compounds. More concrete examples of such compounds include: cristal violet lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-3-methyl-7-anilinofluoran, 3-piperadino-3-methyl-7-anilinofluoran, and the like.

As the color developer, the acidic materials generally used for thermosensitive paper can be employed. Exemplary of such acidic materials are phenol, p-t-butylphenol, p-phenylphenol, naphthol, p-hydroxyacetophenone, 2,2'-dihydroxydiphenol, 4,4'-isopropylidene(2-t-butylphenol), 4,4'-isopropylidenediphenol, 4,4'-cyclohexylidenediphenol, novolak phenol resin, benzoic acid, p-t-butylbenzoic acid, p-hydroxybenzoic acid, benzyl p-hydroxybenzoate, methyl p-hydroxybenzoate, and the like.

As the binder, one can use water-soluble binders such as starch, hydroxyethyl cellulose, methyl cellulose, carboxymethyl cellulose, gelatin, casein, polyvinyl alcohol, modified polyvinyl alcohol, styrene-maleic anhydride copolymer, ethylene-maleic anhydride copolymer, etc., and latex type water-insoluble binders such as styrene-butadiene copolymer, acrylonitrile-butadiene copolymer, methyl acrylate-butadiene copolymer, etc.

As the pigment, diatomaceous earth, talc, kaolin, calcined kaolin, calcium carbonate, magnesium carbonate, titanium oxide, zinc oxide, silicon oxide, aluminum hydroxide, ureaformaldehyde resin and the like can be used.

Other substances that can be used as additives include a higher fatty acid metal salt such as zinc stearate, calcium stearate, etc., or a wax such as paraffin, oxidized paraffin, polyethylene, oxidized polyethylene, stearic acid amide, castor wax, etc., used for the prevention of head wear or sticking, as well as a dispersant such as sodium dioctylsulfosuccinate, and ultraviolet absorber (such as benzophenone or benzotriazole type), a surfactant, a fluorescent dye and the like.

As the support used in the thermosensitive recording material according to this invention, paper is preferably used, but it is also possible to use various types of non-woven fabric, plastic film, synthetic paper, metal foil and the like or a composite sheet made by combining them.

The present invention will be described in further detail below by way of the examples thereof, but it is to be understood that the invention is not limited in its scope to these examples.

EXAMPLE 1

20 g of 3-diethylamino-6-methyl-7-anilinofluoran was dispersed in 60 g of a 2% polyvinyl alcohol solution in a ball mill for a period of 24 hours. In the meantime, 50 g of benzyl p-hydroxybenzoate and 20 g of bis(3-t-butyl-4-hydroxyphenyl)terephthalate were dispersed in 210 g of a 2% polyvinyl alcohol solution in a ball mill for a period of 24 hours. Both dispersions were mixed and the mixture was added with 100 g of a 50% dispersion of calcium carbonate and then further added with 50 g of a 20% dispersion of zinc stearate, 250 g of a 12% polyvinyl alcohol solution and 230 g of water, followed by mixing under stirring to prepare a coating color.

This coating color was coated on a support paper with a basis weight of 50 g/m$^2$ so that the amount of dye precursor would become 0.5 g/m$^2$ and, after drying, the coated paper was supercalendered to obtain a thermosensitive recording material.

EXAMPLE 2

A thermosensitive recording material was obtained by following the same procedure as in Example 1 except for use of bis(3-chloro-4-hydroxyphenyl)isophthalate in place of bis(3-t-butyl-4-hydroxyphenyl)terephthalate.

EXAMPLE 3

A thermosensitive recording material was obtained in the same manner as in Example 1 except for use of bis(3-t-butyl-4-hydroxyphenyl)phthalate in place of bis(3-t-butyl-4-hydroxyphenyl)terephthalate.

COMPARATIVE EXAMPLE 1

A thermosensitive recording material was obtained according to the same process as in Example 1 except for use of N-hydroxymethyl stearic acid amide in place of bis(3-t-butyl-4-hydroxyphenyl)terephthalate.

COMPARATIVE EXAMPLE 2

A thermosensitive recording material was obtained in the same way as in Example 1 except that no bis(3-t-butyl-4-hydroxyphenyl)terephthalate was used.

The thermosensitive recording materials obtained in Examples 1, 2 and 3 and Comparative Examples 1 and 2 were subjected to the following tests for evaluation.

TESTS

Printing was conducted with the respective thermosensitive recording materials by using a thermosensitive facsimile tester under the conditions of applied pulse width = 1.8 msec and applied voltage = 16.00 V to obtain the developed color images and these images were subjected to the following preservation tests. The results are shown in Table 1. The density of the developed color images was measured by using Macbeth Densitometer RD-514.

(a) Developed color image density was measured.

(b) Heat resistance test: After 24-hour preservation under the environment of 60° C., the image density was measured and the image retention was determined from the following formula:

$$\text{Image retention (\%)} = \frac{\text{image density after test}}{\text{image density before test}} \times 100$$

(c) Wet heat resistance test: After 24-hour preservation under the environment of 40° C. and 90% RH, the image density was measured and the image retention was determined.

(d) Oil resistance test: The image portion was strongly pressed by the bulb of a finger and then left at room temperature for 5 days, and thereafter the image density was measured and the image retention was determined.

(e) Water resistance test: After immersing the image in 3 liters of water for 24 hours, the image density was measured and the image retention was determined.

TABLE 1

| | Test | | | | |
|---|---|---|---|---|---|
| | (a) Developed color density | (b) Image retension in heat resistance test | (c) Image retention in wet heat resistance | (d) Image retension in oil resistance test | (e) Image retension in water resistance test |
| Example 1 | 1.01 | 98% | 99% | 96% | 78% |
| Example 2 | 1.02 | 94 | 97 | 98 | 79 |
| Example 3 | 1.03 | 95 | 97 | 95 | 83 |
| Comp. Example 1 | 0.98 | 88 | 83 | 52 | 50 |
| Comp. Example 2 | 0.94 | 82 | 84 | 40 | 50 |

It is seen from Table 1 that the image stabilizer used in the present invention can remarkably improve the image keeping quality under various conditions without affecting the color development.

What is claimed is:

1. A thermosensitive recording material comprising a thermosensitive recording layer provided on a support and containing a usually colorless or light-color dye precursor and a color developer which reacts with said dye precursor when heated to effect color development of said dye precursor, said thermosensitive layer further containing a compound represented by the general formula:

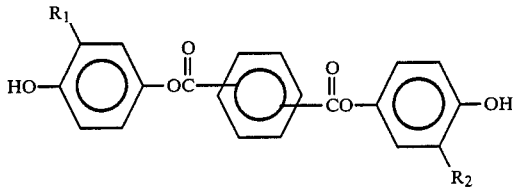

(wherein $R_1$ and $R_2$ represent an alkyl group or a halogen).

2. A thermosensitive recording material according to claim 1, wherein $R_1$ and $R_2$ in the general formula represent an alkyl group having 1 to 4 carbon atoms.

3. A thermosensitive recording material according to claim 2, wherein the compound of the general formula is bis(3-t-butyl-4-hydroxyphenyl)terephthalate.

4. A thermosensitive recording material according to claim 2, wherein the compound of the general formula is bis(3-t-butyl-4-hydroxyphenyl)phthalate.

5. A thermosensitive recording material according to claim 1, wherein $R_1$ and $R_2$ in the general formula represent chlorine.

6. A thermosensitive recording material according to claim 5, wherein the compound of the general formula is bis(3-chloro-4-hydroxyphenyl)isophthalate.

7. A thermosensitive recording material according to claim 1, wherein the compound of the general formula is contained in an amount of 10 to 250% by weight based on the dye precursor.

8. A thermosensitive recording material according to claim 7, wherein the compound of the general formula is contained in an amount of 25 to 200% by weight.

* * * * *